US006899229B2

(12) United States Patent
Dennison et al.

(10) Patent No.: US 6,899,229 B2
(45) Date of Patent: May 31, 2005

(54) PACKAGING CONTAINER WITH INTEGRATED SHEET FOR RETENTION OF PACKAGED ARTICLE

(75) Inventors: Timothy S. Dennison, Greer, SC (US); Lawrence J. Pillote, Naperville, IL (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 90 days.

(21) Appl. No.: 10/623,183

(22) Filed: Jul. 18, 2003

(65) Prior Publication Data

US 2005/0011807 A1 Jan. 20, 2005

(51) Int. Cl.[7] ..... B65D 85/30
(52) U.S. Cl. ..... 206/583; 206/594
(58) Field of Search ..... 206/583, 594, 206/320, 521, 591, 477, 478

(56) References Cited

U.S. PATENT DOCUMENTS

| | | | | |
|---|---|---|---|---|
| 3,669,337 A | * | 6/1972 | Struble | 206/583 |
| 3,853,220 A | | 12/1974 | Luray | |
| 3,876,812 A | | 4/1975 | Peters | |
| 4,087,003 A | | 5/1978 | Adamek | |
| 4,773,534 A | | 9/1988 | DeHeras et al. | |
| 4,852,743 A | | 8/1989 | Ridgeway | |
| 5,056,665 A | | 10/1991 | Boecker et al. | |
| 5,071,009 A | | 12/1991 | Ridgeway | |
| 5,211,290 A | | 5/1993 | Janus et al. | |

(Continued)

FOREIGN PATENT DOCUMENTS

EP 1 149 774 A2 10/2001

(Continued)

OTHER PUBLICATIONS

Korrvu®—Suspension Packaging and Retention Packaging Product Pamphlet, Jul. 2000.

*Primary Examiner*—Jila M. Mohandesi
(74) *Attorney, Agent, or Firm*—Alston & Bird LLP

(57) ABSTRACT

The invention provides a packaging container including a box adjustable between an open configuration and a closed configuration, the box including a plurality of side panels and a bottom arranged to define a storage compartment and an opening, the storage compartment being accessible through the opening when the box is in the open configuration. A first flap and a second flap form a first pair of opposing flaps, each of the first and second flaps being attached to a corresponding side panel and adapted for folding across at least a portion of the opening when the box is in the closed configuration. The box includes a second pair of opposing flaps, each flap of the second pair of opposing flaps being attached to a corresponding side panel and adapted for folding across at least a portion of the opening when the box is in the closed configuration. A sheet is provided, having a first end affixed to the first flap and a second end affixed to the second flap, wherein when the box is in the closed configuration, a first portion of the sheet is within the storage compartment, a second portion of the sheet is between the first flap and at least one flap of the second pair of opposing flaps, and a third portion of the sheet is between the second flap and at least one flap of the second pair of opposing flaps.

29 Claims, 6 Drawing Sheets

U.S. PATENT DOCUMENTS

| | | | |
|---|---|---|---|
| 5,226,542 | A | 7/1993 | Boecker et al. |
| 5,251,760 | A | 10/1993 | Smith et al. |
| 5,259,507 | A | 11/1993 | Smith |
| 5,323,896 | A | 6/1994 | Jones |
| 5,388,701 | A | 2/1995 | Ridgeway |
| 5,579,917 | A | 12/1996 | Lofgren et al. |
| 5,669,506 | A | 9/1997 | Lofgren et al. |
| 5,678,695 | A | 10/1997 | Ridgeway et al. |
| 5,722,541 | A | 3/1998 | Lofgren et al. |
| 5,823,348 | A | 10/1998 | Phillips et al. |
| 5,893,462 | A | 4/1999 | Ridgeway |
| 5,894,932 | A | 4/1999 | Harding et al. |
| 5,967,327 | A | 10/1999 | Jones |
| 5,975,307 | A | 11/1999 | Harding et al. |
| 5,988,387 | A | 11/1999 | Staal et al. |
| 6,016,919 | A | 1/2000 | Smith et al. |
| 6,148,590 | A | 11/2000 | Ridgeway et al. |
| 6,158,589 | A | 12/2000 | Smith et al. |
| 6,223,901 | B1 | 5/2001 | Lofgren et al. |
| 6,302,274 | B1 | 10/2001 | Ridgeway |
| 6,467,624 | B1 | 10/2002 | Lofgren et al. |
| 2002/0144926 | A1 | 10/2002 | Rutledge |
| 2003/0062405 | A1 | 4/2003 | Luu et al. |

FOREIGN PATENT DOCUMENTS

| | | |
|---|---|---|
| WO | WO 00/53499 | 9/2000 |

* cited by examiner

PACKAGING CONTAINER WITH INTEGRATED SHEET FOR RETENTION OF PACKAGED ARTICLE

FIELD OF THE INVENTION

The present invention relates packaging containers or boxes, particularly containers incorporating a sheet for retention of a packaged article within the container.

BACKGROUND OF THE INVENTION

Protective packaging structures are often used when an article to be transported requires protection from physical shock, dust, dirt and other contaminants. For example, when shipping articles that may be relatively fragile, it is often desirable to package the article inside a box to protect the article from physical impacts to the box that may occur during loading, transit and unloading. In addition, when shipping sensitive electronic articles, such as computer components, it is often desirable to protect those components from dust and dirt. Aside from the shipping box-itself, some additional packing materials are often needed to prevent the article from being damaged by uncontrolled movement within the box. Such additional packing material may comprise, for example, paper or plastic dunnage, molded plastic foam, foam-filled cushions, and the like.

One useful form of packaging for especially fragile articles is referred to as suspension packaging, examples of which are disclosed in U.S. Pat. No. 4,852,743 to Louis H. Ridgeway and U.S. Pat. No. 5,388,701 to Devin C. Ridgeway. In suspension packaging, the article is suspended between two sheets of plastic film. The sheets are usually attached to frames that are sized to fit securely within a selected size box. The fact that the article is not in contact with any substantially rigid surfaces protects it from physical shock. It is not necessary in all cases, however, for the article to be entirely suspended within the box, such as when packaging less fragile articles. In such cases, the extra space required for full suspension packaging becomes a less efficient use of such materials.

An alternative to suspension packaging is referred to as retention packaging, examples of which are disclosed in U.S. Pat. No. 5,678,695 to Devin C. Ridgeway et al. In retention packaging, an article is positioned between a sheet of flexible film and a rigid backing. The film is connected to folding side portions of the rigid backing such that the film is tightened against the article as the rigid side portions are folded away from the film. The folded structure fits within a selected box size that holds the article securely in place, but in contact on one side with a rigid surface. While retention packaging reduces the overall size of the packaging, placing the article between the flexible film and rigid backing is a cumbersome process and may increase the overall time needed to package each article. When packaging many thousands of articles, this incremental increase in time may have a substantial overall impact on shipping costs.

There remains a need in the art for packaging structures that are easier and less time-consuming to use than prior art packaging structures. Preferably, such structures will make efficient use of materials so as to be able to package articles in smaller containers than previously possible without sacrificing the strength of the packaging structure.

SUMMARY OF THE INVENTION

In one aspect, the present invention provides a packaging container for an article, the container comprising a box adjustable between an open configuration and a closed configuration. The box comprise a plurality of side panels and a bottom panel or surface arranged to define a storage compartment that is accessible through an opening when the box is in the open configuration. A first flap and a second flap form a first pair of opposing flaps, each of the first and second flaps being attached to corresponding side panels of the plurality of side panels and adapted for folding across at least a portion of the opening when the box is in the closed configuration. In one embodiment, the box also includes a second pair of opposing flaps that are also attached to a corresponding side panel of the plurality of side panels and adapted for folding across at least a portion of the opening when the box is in closed configuration. The box further comprises a sheet having a first end affixed to the first flap and a second end affixed to the second flap. When the box is in the closed configuration, a first portion of the sheet is within the storage compartment, a second portion of the sheet is between the first flap and at least one of the second pair of opposing flaps, and a third portion of the sheet is between the second flap and at least one of the second pair of opposing flaps.

In another embodiment, the packaging container of the invention comprises a box that comprises a plurality of side panels, a bottom, and a first pair of opposing flaps as described above, and additionally includes a third flap attached to a corresponding side panel of the plurality of side panels and adapted for folding across at least a portion of the opening when the box is in the closed configuration. In this embodiment, when the box is in the closed configuration, a first portion of a sheet, which has a first end affixed to the first flap and a second end attached to the second flap, is within the storage compartment. A second portion of the sheet is between the first flap and the third flap and a third portion of the sheet is between the second flap and the third flap.

In a further aspect, the present invention provides a packaged article comprising a packaging container as described above, wherein the box is in the closed configuration, and an article within the storage compartment and retained between the first portion of the sheet and each of the first and second pairs of flaps.

In yet another aspect, the invention provides a method of packaging an article, the method comprising providing a packaging container as described above, positioning the box in the open configuration, placing an article to be packaged on the sheet, folding the second pair of flaps across at least a portion of the opening, and subsequently folding the first pair of opposing flaps across at least a portion of the opening and over the second pair of flaps to place the box in the closed configuration and to retain the article between the first portion of the sheet material and at least one flap selected from the first and second pairs of flaps.

BRIEF DESCRIPTION OF THE DRAWINGS

Figure 1:
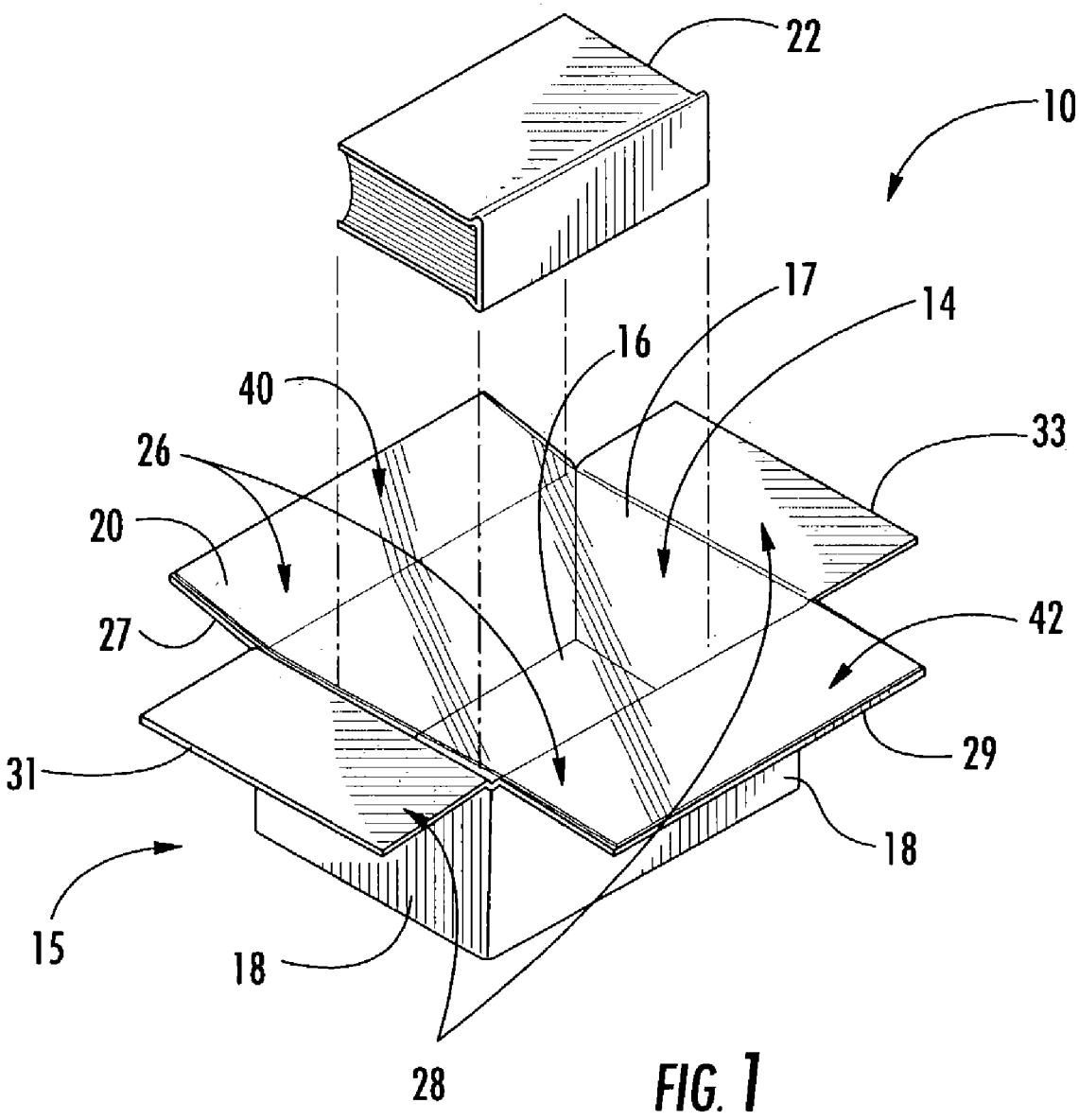
Figure 2:
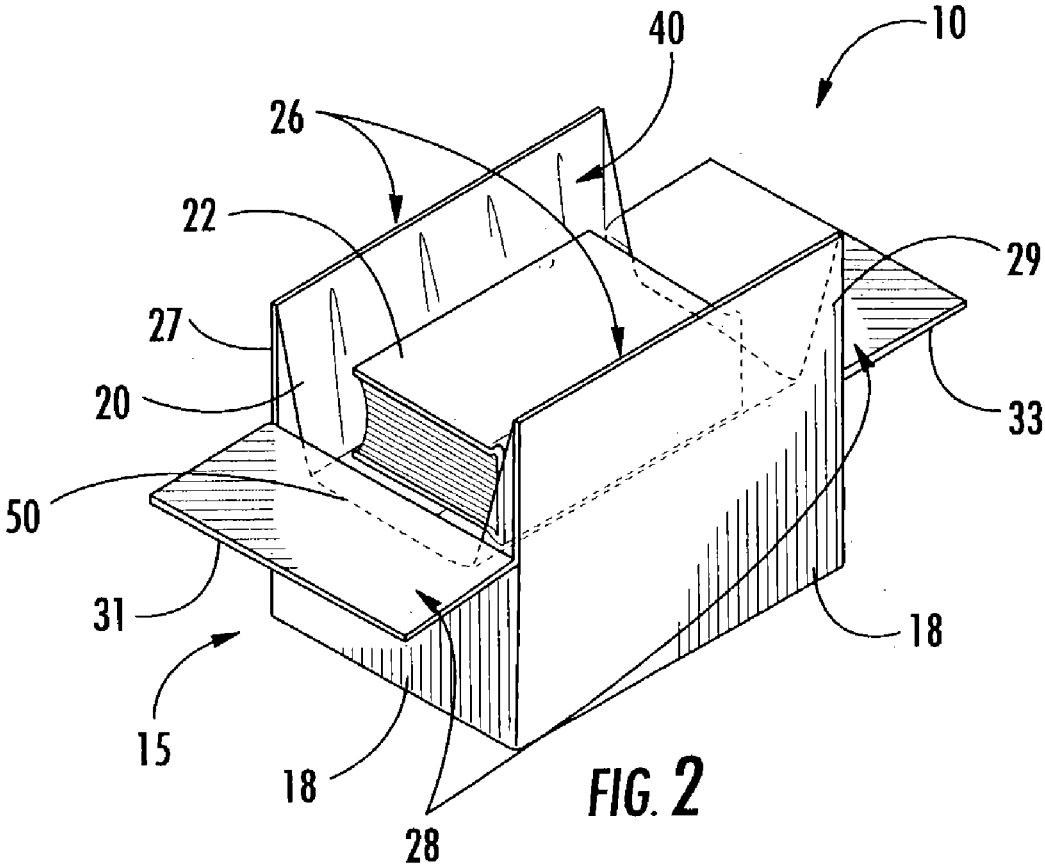
Figure 3:
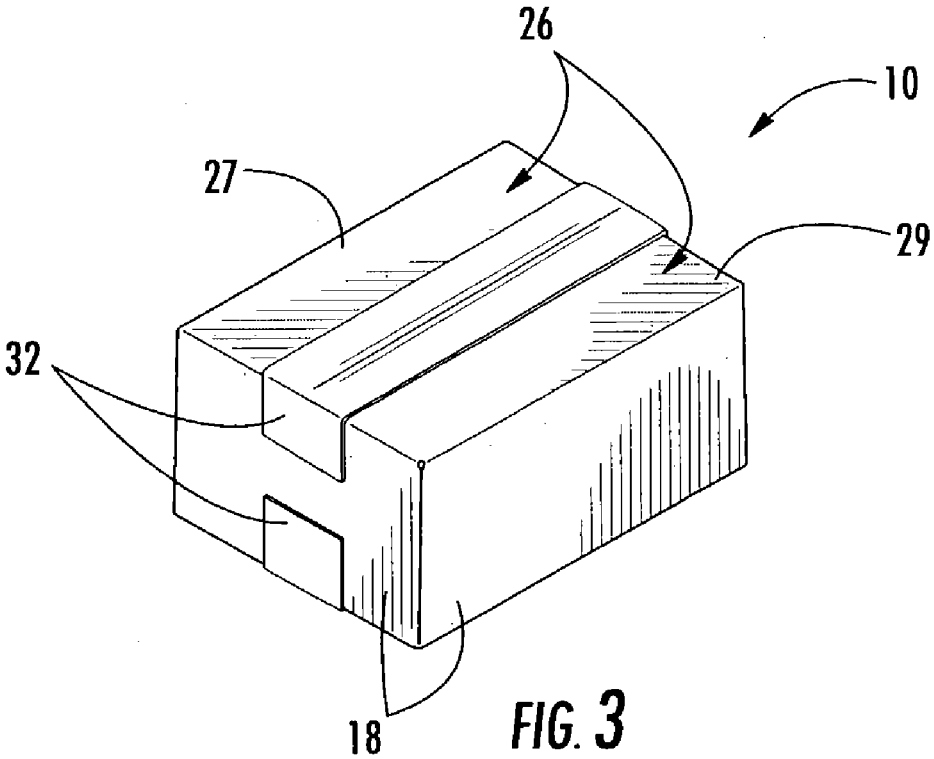
Figure 4:
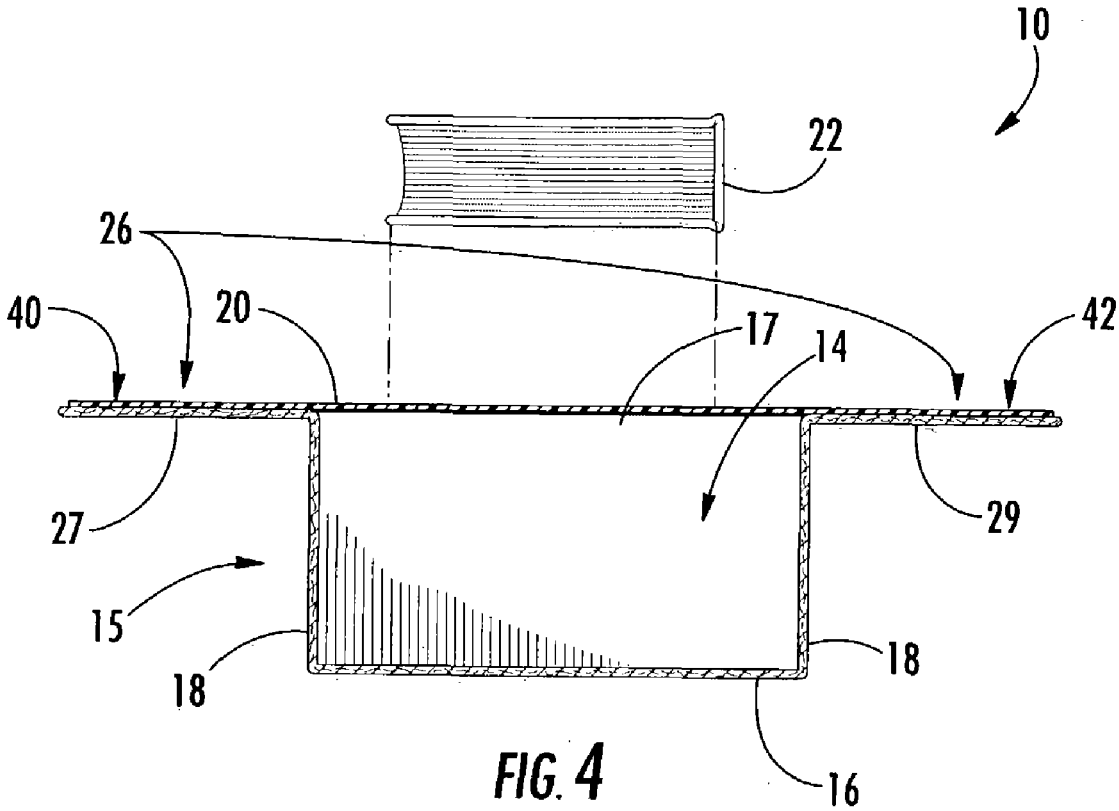
Figure 5:
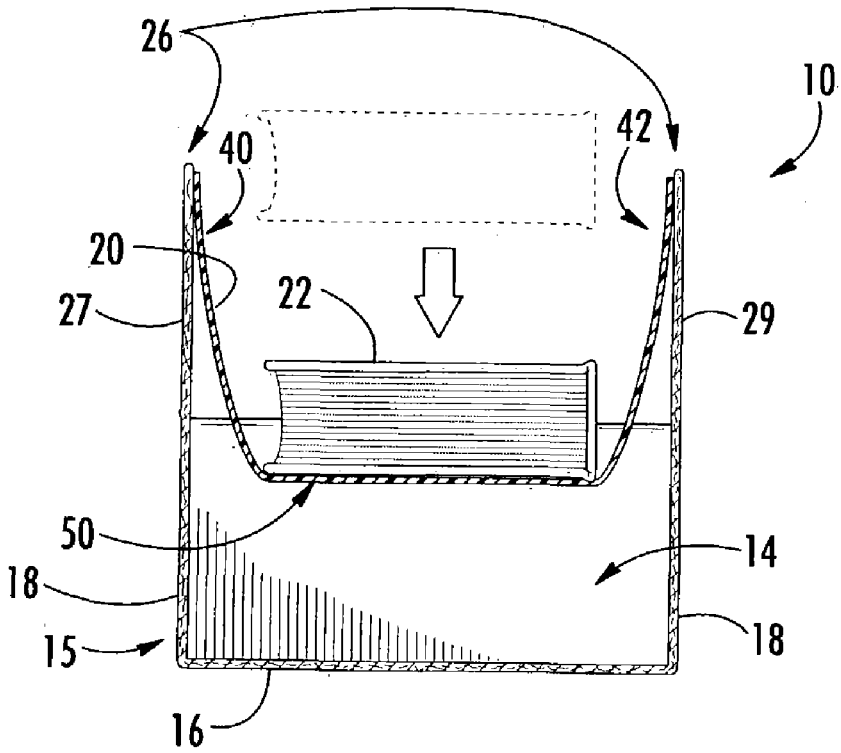
Figure 6:
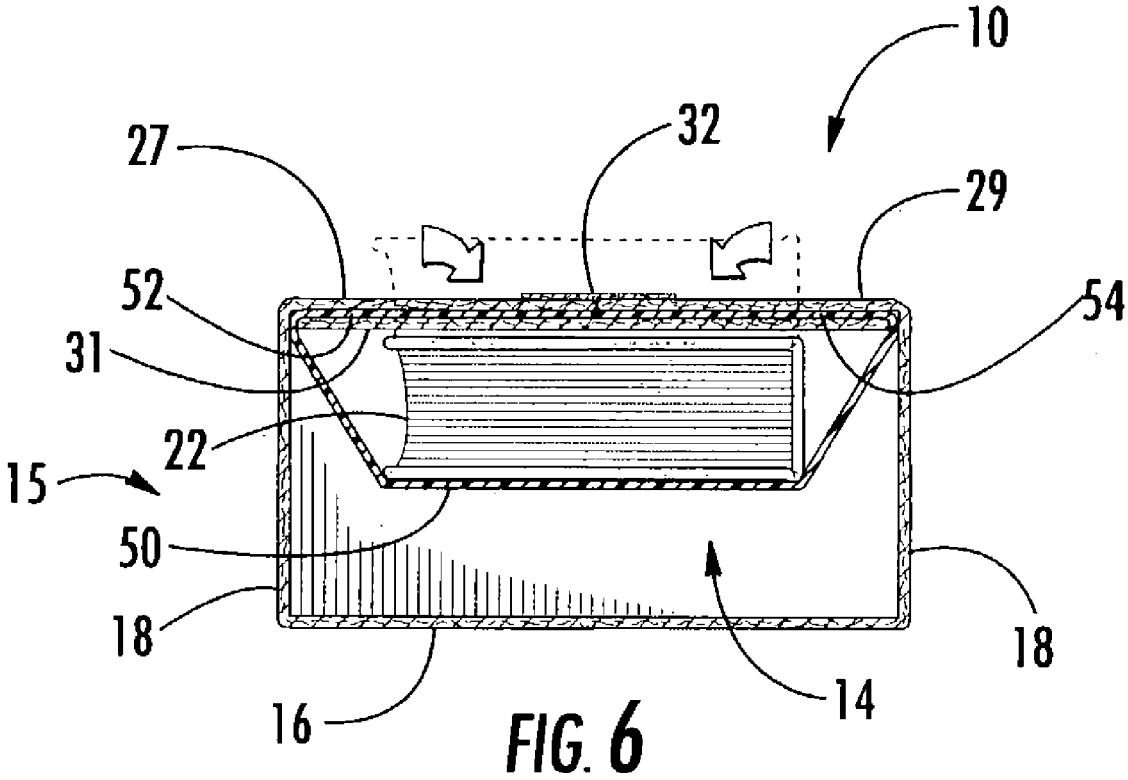
Figure 7:
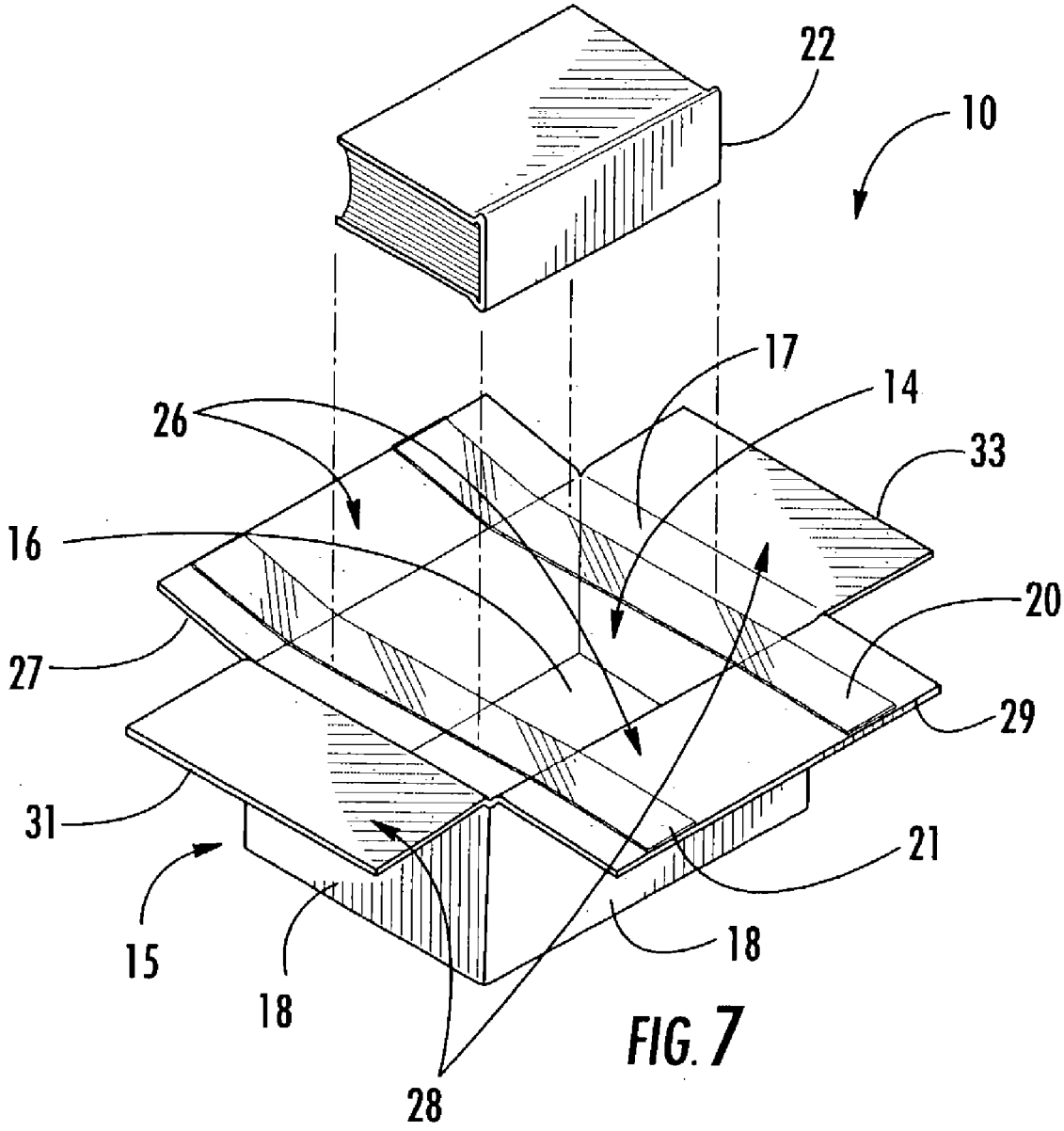
Figure 8:
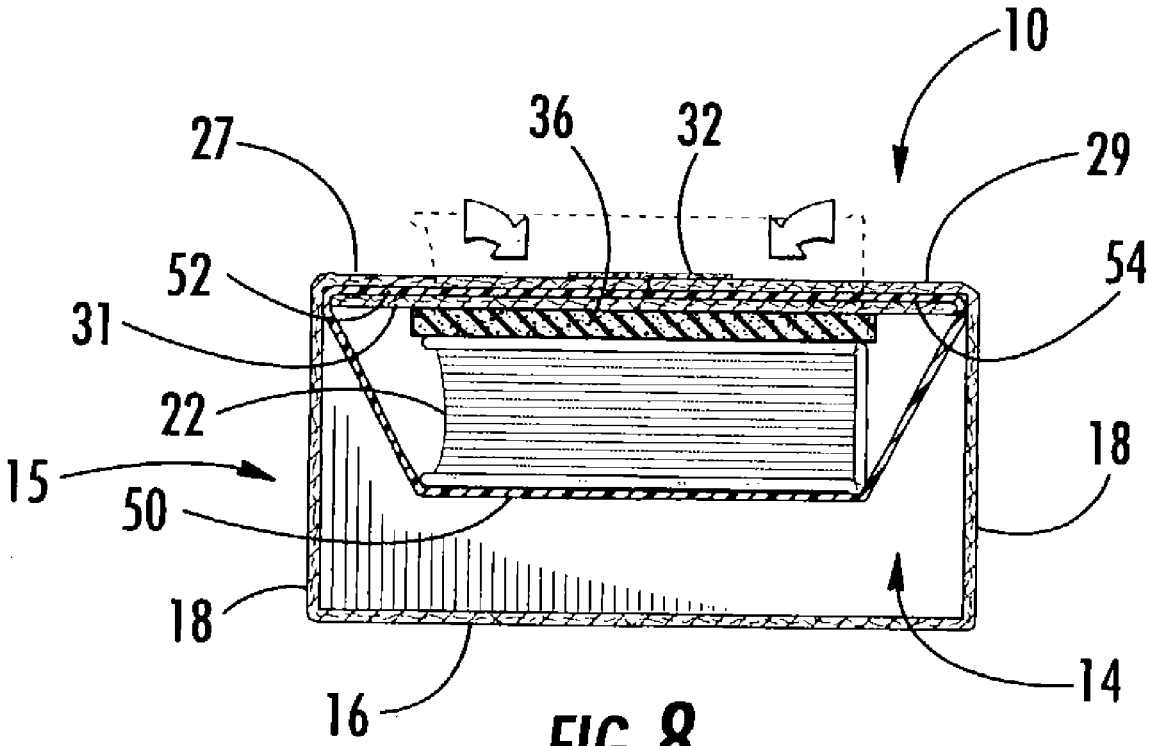

Having thus described the invention in general terms, reference will now be made to the accompanying drawing, which is not necessarily drawn to scale and wherein:

FIG. 1 is a perspective view of a packaging container according to the invention prior to placement of the article within the container;

FIG. 2 is a perspective view of a packaging container according to the invention after placement of an article on the sheet;

FIG. 3 is a perspective view of a packaging container according to the invention following closure and sealing of the container;

FIG. 4 is a cross-sectional side view of a packaging container according to the invention prior to placement of an article within the container;

FIG. 5 is a cross-sectional side view of a packaging container according to the invention after placement of the article within the container;

FIG. 6 is a cross-sectional side view of a packaging container according to the invention following closure and sealing of the container;

FIG. 7 is a perspective view of an alternate embodiment of the packaging container according to the invention comprising more than one sheet; and FIG. 8 is a cross-sectional side view of a packaging container according to the invention that includes a cushioning insert.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used in this specification, the singular forms "a," "an," and "the" include plural referents unless the context clearly dictates otherwise. The term "comprising" and variations thereof as used herein is used synonymously with the term "including" and variations thereof and is an open, non-limiting term.

Multiple embodiments of the packaging container of the present invention are described herein. The packaging container comprises a box and a sheet. The box comprises a plurality of side panels and a bottom (i.e.; bottom panel or surface) arranged to define a storage compartment, and at least one pair of opposing flaps adapted for folding across at least a portion of the opening of the storage compartment. The sheet is affixed to one or more of the closure flaps.

The side walls, bottom and flaps of the box may be formed from any substantially rigid, lightweight, foldable material, such as cardboard, plastic, compressed foam, paperboard, corrugated cardboard and the like. A useful material is a single wall corrugated cardboard such as B-flute or C-flute corrugated cardboard. In accordance with techniques which are generally known in the packaging art, a single panel or blank of such material may be folded according to predetermined patterns to yield containers having a desired size and structural features for a particular application. The packaging container may comprise an RSC-type container known in the art. The box may comprise a polyhedron-shaped storage compartment, meaning the side panels, bottom and closure flaps are polygon-shaped (e.g., rectangular).

The sheet may be flexible and resilient, for example, so that the sheet can cradle or support a packaged article without damaging the sheet or the packaged article. The sheet may have any total thickness as long as it provides the desired properties (e.g., flexibility, elasticity, optics, strength) for the given packaging application of expected use. The sheet may have a thickness of less than about any of the following: 10 mils, 6 mils, 5 mils, 4 mils, 3 mils, 2 mils, 1.5 mils, and 1 mil. (A "mil" is equal to 0.001 inch.) The sheet may also have a thickness of at least about any of the following: 0.5 mils, 1 mil, 1.5 mils, 2 mils, and 3 mils.

The sheet may have an elastic recovery in either or both of the transverse and longitudinal directions of at least about any of the following values: 60%, 65%, 70%, 75%, 80%, and 85%, measured according to ASTM D5459-95 at 100% strain, 30 seconds relaxation time, and 60 second recovery time.

The sheet may have a maximum load tear resistance in either or both of the transverse and longitudinal directions of at least about any of the following values: 400, 450, 500, 550, and 600 grams force, measured according to ASTM D1004-94a.

The sheet may have a slow puncture maximum load of at least about any of the following values: 4, 4.5, 5, 5.5, 6, 6.5, and 7 pounds force, measured according to ASTM F1306-90 using a crosshead speed of 5 inches per minute.

The sheet may have a Young's modulus sufficient to withstand the expected handling and use conditions, yet provide a "soft" feel that may be desirable for a packaging application. The sheet may have a Young's modulus of at least about any of the following values: 2,000; 2,500; 3,000; 3,500; and 4,000 pounds/square inch. The sheet may have a Young's modulus of no more than about any of the following values: 8,000; 10,000; 15,000; 20,000; 30,000; and 40,600 pounds/square inch. The Young's modulus is measured in accordance with ASTM D882, measured at a temperature of 73° F.

The sheet may be transparent so that the packaged article may be visible through the sheet. "Transparent" as used herein means that the material transmits incident light with negligible scattering and little absorption, enabling objects to be seen clearly through the material under typical unaided viewing conditions (i.e., the expected use conditions of the material). The transparency (i.e., clarity) of the sheet may be at least about any of the following values: 65%, 70%, 75%, 80%, 85%, and 90%, measured in accordance with ASTM D1746.

The sheet may have a heat-shrink attribute. For example, the sheet may have any of a free shrink in at least one direction (i.e., machine or transverse directions), in each of at least two directions (i.e., machine and transverse directions), or a total free shrink measured at any of 160° F. and 180° F. of at least about any of the following: 7%, 10%, 15%, 20%, 25%, 30%, 40%, 50%, 55%, 60%, and 65%. Alternatively, the sheet may be non-heat shrinkable (i.e., has a total free shrink of less than 5% measured at 160° F.).

As is known in the art, the total free shrink is determined by summing the percent free shrink in the machine (longitudinal) direction with the percentage of free shrink in the transverse direction. For example, a sheet that exhibits 50% free shrink in the transverse direction and 40% free shrink in the machine direction has a total free shrink of 90%. Although preferred, it is not required that the sheet have shrinkage in both directions. Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

The sheet may comprise, for example, one or more fabrics. Useful fabrics include wovens, knits, nonwovens, and openwork meshes (e.g., netting). Exemplary fabrics also include various types of spandex, including Lycra® brand spandex, and elastic fabrics.

The sheet may comprise one or more polymers. Exemplary polymers include thermoplastic polymers, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), polyurethane, and other polyolefins. The sheet may also comprise thermoplastic polyolefin elastomers (TPOs), which are two-component elastomer systems comprising an elastomer (such as EPDM) finely dispersed in a thermoplastic polyolefin (such as polypropylene or polyethylene). "Copolymer" as used in this application means a polymer derived from two or more types of monomers, and includes terpolymers, etc.

Exemplary EAOs include one or more of the following: 1) medium density polyethylene ("MDPE"), for example having a density of from 0.93 to 0.94 g/cm3; 2) linear medium density polyethylene ("LMDPE"), for example having a density of from 0.926 to 0.94 g/cm3; 3) linear low density polyethylene ("LLDPE"), for example having a density of from 0.915 to 0.930 g/cm3; 4) very-low or ultra-low density polyethylene ("VLDPE" and "ULDPE"), for example having density below 0.915 g/cm3, and 5) homogeneous EAOs.

The sheet may be manufactured by thermoplastic film-forming processes known in the art (e.g., tubular or blown-film extrusion, coextrusion, extrusion coating, flat or cast film extrusion). A combination of these processes may also be employed.

At least one side of the sheet may be corona and/or plasma treated to change the surface energy of the film, for example, to increase the ability of the sheet to adhere to a flap.

The sheet may comprise effective amounts of one or more of tackifiers, antiblocking agents, and slip agents—or may be essentially free of any of these components. Tackifiers, antiblocking agents, and slip agents, and their effective amounts, are known to those of ordinary skill in the art.

A sheet comprising polyvinyl chloride may be useful for lightweight applications, for example, where a thickness of only 2–4 mils may be desirable. A sheet comprising polyurethane (e.g., SP876, a commercially available product of the BASF Company) may be useful for packaging a large article or an article having sharp protrusions. A sheet comprising polyurethane may provide desirable elastomeric, puncture resistance, temperature resistance, and tackiness characteristics.

Useful sheets (i.e., films) are described in copending U.S. patent application Ser. No. 10/147,704 filed May 16, 2002 entitled "Packaging Structure Having a Frame and Film," which is incorporated herein in its entirety by reference.

The invention will now be described with reference to the figures, wherein an RSC-type embodiment of the box of the invention is shown. Typically, a box of the type shown in FIG. 1 is constructed of a single piece of material, such as a single piece of corrugated cardboard, and simply folded to form the desired container shape.

The box is adjustable between an open configuration, as shown in FIGS. 1–2, 4–5, and 7, and a closed configuration, as shown in FIGS. 3, 6, and 8.

Referring to FIG. 1 and corresponding cross-sectional view in FIG. 4, the packaging container 10 includes a box 15 comprising side panels 18 and a bottom 16 (i.e., bottom surface or panel) to define storage compartment 14. The bottom 16 may be formed from a single panel as illustrated or may be formed by closing two pairs of opposing foldable flaps (not shown). The storage compartment 14 is accessible through an opening 17 through which an article 22 may enter the storage compartment. The box 15 may be closed by covering the opening 17 of the storage compartment 14 with one or more of flaps 27, 29, 31, and 33. Flaps 27 and 29 form a first pair of opposing flaps 26. Each of flaps 27 and 29 are attached (e.g., foldably or hingedly attached) to a corresponding side panel 18. As shown, flaps 27 and 29 are "major" flaps, since they extend along the longer of the side panels 18. Flaps 31 and 33 form a second pair of opposing flaps 28. Each of flaps 31 and 33 are attached to a corresponding side panel 18. As shown, flaps 31 and 33 are "minor" flaps, since they extend along the shorter side walls 18.

The first pair of flaps 26 and the second pair of flaps 28 are each adapted for folding across at least a portion of the opening 17 of the storage compartment 14 to place the box in the closed configuration. Each of the flaps is attached to its corresponding side panel 18. As shown in FIG. 1, the minor flap pair 28 may be dimensioned so as to extend across only a portion of the opening of the storage compartment 14, while the major flap pair 26 may be dimensioned to cover substantially the entirety of the opening of the storage compartment. The major flap pair 26 and the minor flap pair 28 can be arranged in a perpendicular configuration, meaning the major flaps and their associated side panels 18 are roughly perpendicular to the minor flaps and their associated side panels (i.e., the container is rectangular).

A sheet 20 extends across the opening 17 of the storage compartment 14. The first end 40 of sheet 20 is attached or affixed to flap 27. The second end 42 is affixed to flap 29. The sheet 20 may be affixed to the flaps using any means of affixation known in the art, such as staples, tape, glue, pressure sensitive adhesives, or other adhesives known in the art.

Although not shown in the drawings, the sheet may alternatively or additionally be attached to the minor flap pair 28. However, by only attaching the sheet 20 to the major flaps 26, when using an RSC-type container designed to be collapsed and palletized prior to use, the sheet 20 may be less likely to inhibit the collapse of the container into a substantially flat configuration that is easily palletized.

The sheet 20 can be adhered to the flaps at any location on the flaps between the point of attachment of the flaps to the side panel 18 and the outer edge of the flaps distal to the panels 18. The sheet may be affixed to the flap proximate to the outer edge of the flap distal to the point of attachment of the flap to the side panel 18. By affixing the sheet 20 proximate to the outer edge of the major flaps 26, greater stretching of the film may occur when the box is placed in the closed configuration.

To provide greater flexibility to the end user of the container, packaging container can be provided to the user with only the first end 40 of the sheet 20 attached to flap 27, while the other end 42 may be attached by the end user at the desired location along flap 29. To facilitate attachment by the end user, the end 42 of the sheet 20 may carry a layer of adhesive, such as a pressure sensitive adhesive (not shown), or be otherwise adapted for affixation to the flap 29. The end user can determine a desirable position for affixing the second end 42 of the sheet 20 to the flap 29 based on the physical characteristics (e.g., size, weight, etc.) of the article 22 to be packaged. The sheet 20, which is of sufficient size to span the opening 17 of the storage compartment 14, can thus be adjusted to the desired level of tautness prior to use. The level of tautness in the sheet 20 will determine the amount of stretching or deformation that the sheet may undergo upon placing the box in the closed configuration to package the article 22.

As shown in FIG. 1, a single sheet 20 can extend across substantially the entirety of the opening 17 of the storage compartment 14. Alternatively, multiple sheets can extend across the opening the storage compartment. In the embodiment shown in FIG. 7, the first sheet 20 does not cover the entirety of the opening 17. Instead, a second sheet 21 is also attached to the flaps 27 and 29.

FIG. 2, and the corresponding cross-sectional side view in FIG. 5, illustrate initial placement of an article 22 in the packaging container 10 of the invention. As shown, placement of the article 22 on the sheet 20 results in downward deflection of the sheet such that a first portion 50 of the sheet is within the storage compartment 14. This also results in raising of the major flaps 26 from a substantially horizontal position to a more vertical orientation. After placement of the article 22 upon the sheet 20, the minor flaps 28 may be folded across at least a portion of the opening 17 to contact the article 22. Closure of the minor flaps 28 may result in greater downward deflection of the stretchable film 20 as the article 22 is pushed further into the storage compartment 14. As shown in FIG. 6, once the minor flaps 28 are closed, the major flaps 26 may be closed such that a second portion 52 of the sheet is between flap 27 and the second pair of flaps 31 and 33, and a third portion 54 of the sheet is between flap 29 and the second pair of flaps 31 and 33. As shown, the major flaps overlay the minor flaps and extend substantially across the entirety of the opening of the storage compartment 14 to place the box 15 in the closed configuration.

Referring now to FIG. 3 and corresponding cross-sectional side view FIG. 6, once the closure flap pairs 26 and 28 are folded to place the box 15 in the closed configuration, then box 10 can be secured in the closed configuration using any securing means 32 known in the art, such as tape, glue, staples, string, rope, wrapping paper, banding straps, and the like.

If sheet 20 has a heat-shrink attribute, then the sheet may be heated to a temperature sufficient to initiate the heat shrink response after the box is closed. This heating step may be accomplished, for example, by placing the packaging container 10 within a shrink tunnel or other oven, exposing the packaging container in total or the sheet itself to a stream of heated gas (e.g., air). For example, a tube may be used to pierce a side panel to gain access to, and supply a stream of heated gas to, the interior of the closed box (e.g., the storage compartment 14).

As shown in FIG. 6, the major flaps 26 may be in substantially abutting contact upon closure of the flaps across the opening of the storage compartment 14. Once the flaps 26 and 28 are closed, the article 22 may be retained within the storage compartment 14 and held securely in place by the sheet 20. Article 22 may be spaced apart from the bottom 16 and side panels 18, thus reducing the need for dunnage or other void-filling materials to protect the article during transport from impacts into the side panels or bottom.

In the embodiment shown in FIG. 8, a cushioning insert 36 is placed in the packaging container 10 between the article 22 and the flaps 26 and 28 to further protect the packaged article. Also, a cushioning insert may be placed between the article 22 and the first portion 50 of the sheet 20 (not shown). Useful cushioning inserts include any cushioning or dunnage materials known in the art, for example, paper or plastic dunnage, foam products, and air-inflated pillows and cushions.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A packaging container for an article, comprising:

a box adjustable between an open configuration and a closed configuration, said box comprising:

a plurality of side panels and a bottom arranged to define a storage compartment and an opening, said storage compartment being accessible through said opening when said box is in said open configuration;

a first flap and a second flap forming a first pair of opposing flaps, each of said first and second flaps being attached to a corresponding side panel of said plurality of side panels and adapted for folding across at least a portion of said opening when said box is in said closed configuration; and a second pair of opposing flaps, each flap of said second pair of opposing flaps being attached to a corresponding side panel of said plurality of side panels and adapted for folding across at least a portion of said opening when said box is in said closed configuration; and a sheet having a first end affixed to said first flap and a second end affixed to said second flap, wherein when said box is in said closed configuration:

a first portion of said sheet is within said storage compartment;

a second portion of said sheet is between said first flap and at least one flap of said second pair of opposing flaps; and a third portion of said sheet is between said second flap and at least one flap of said second pair of opposing flaps.

2. The packaging container of claim 1, wherein when said box is in said closed configuration:

said second portion of said sheet is between said first flap and said second pair of opposing flaps; and said third portion of said sheet is between said second flap and said second pair of opposing flaps.

3. The packaging container of claim 1, wherein said sheet is affixed solely to said first and second flaps.

4. The packaging container of claim 1, wherein when said box is in said closed configuration, said sheet is adapted to retain the article between said first portion of said sheet and at least one flap selected from said first and second pairs of flaps.

5. The packaging container of claim 1, wherein when said box is in said closed configuration, said sheet is adapted to retain the article between said first portion of said sheet and each of said first and second pairs of flaps.

6. The packaging container of claim 1, wherein said sheet comprises one or more thermoplastic polymers.

7. The packaging container of claim 1, wherein said sheet comprises one or more fabrics.

8. The packaging container of claim 1, wherein said sheet has an elastic recovery in at least one direction of at least about 60%, measured according to ASTM D5459-95 at 100% strain, 30 seconds relaxation time, and 60 second recovery time.

9. The packaging container of claim 1, wherein the sheet comprises polyurethane.

10. The packaging container of claim 1, wherein said sheet has a free shrink in at least one direction measured at 160° F. of at least about 7%.

11. The packaging container of claim 1, wherein said sheet has a size sufficient to extend across substantially the entirety of said opening.

12. The packaging container of claim 1, further comprising a second sheet having a first end affixed to said first flap and a second end affixed to said second flap, wherein when said box is in said closed configuration:

a first portion of said second sheet is within said storage compartment;

a second portion of said second sheet is between said first flap and at least one flap of said second pair of opposing flaps; and a third portion of said second sheet is between said second flap and at least one flap of said second pair of opposing flaps.

13. The packaging container of claim 1, wherein said first end of said sheet is affixed to said first flap proximate to the outer edge of the first flap distal to said side panel corresponding to said first flap.

14. The packaging container of claim 1, wherein:

said first end of said sheet is affixed to said first flap proximate to the outer edge of the first flap distal to said side panel corresponding to said first flap; and said second end of said sheet is affixed to said second flap proximate to the outer edge of the second flap distal to said side panel corresponding to said second flap.

15. The packaging container of claim 1, wherein said storage compartment is in the shape of a polyhedron.

16. The packaging container of claim 1, wherein said box comprises cardboard.

17. The packaging container of claim 1, wherein when said box is in said closed configuration:

said first and second flaps are adapted for substantially abutting contact with each other when the first and second flaps are folded across at least a portion of said opening; and said first and second flaps taken together extend across substantially the entirety of said opening.

18. The packaging container of claim 1, wherein when said box is in said closed configuration:

said first and second flaps are adapted not to contact each other when folded across at least a portion of said opening; and said first and second flaps taken together do not extend across substantially the entirety of said opening.

19. A packaging container for an article, comprising:

a box adjustable between an open configuration and a closed configuration, said box comprising:

a plurality of side panels and a bottom arranged to define a storage compartment and an opening, said storage compartment being accessible through said opening when said box is in said open configuration;

a first flap and a second flap forming a first pair of opposing flaps, each of said first and second flaps being attached to a corresponding side panel of said plurality of side panels and adapted for folding across at least a portion of said opening when said box is in said closed configuration; and a third flap attached to a corresponding side panel of said plurality of side panels and adapted for folding across at least a portion of said opening when said box is in said closed configuration; and a sheet having a first end affixed to said first flap and a second end affixed to said second flap, wherein when said box is in said closed configuration:

a first portion of said sheet is within said storage compartment;

a second portion of said sheet is between said first flap and said third flap; and a third portion of said sheet is between said second flap and said third flap.

20. A packaged article, comprising:

said packaging container of claim 1 wherein said box is in said closed configuration; and an article within said storage compartment and retained between said first portion of said sheet and at least one flap selected from said first and second pairs of flaps.

21. The packaged article of claim 20, wherein said article is retained between said first portion of said sheet and each of said first and second pairs of flaps.

22. The packaged article of claim 20, further comprising a cushioning insert between said article and at least one flap selected from said first and second pairs of flaps.

23. The packaged article of claim 20, further comprising a cushioning insert between said article and said first portion of said sheet.

24. The packaged article of claim 20, further comprising means for securing said box in said closed configuration.

25. A method of packaging an article, comprising:

providing a packaging container comprising:

a box adjustable between an open configuration and a closed configuration, said box comprising:

a plurality of side panels and a bottom arranged to define a storage compartment and an opening, said storage compartment being accessible through said opening when said box is in said open configuration;

a first flap and a second flap forming a first pair of opposing flaps, each of said first and second flaps being attached to a corresponding side panel of said plurality of side panels and adapted for folding across at least a portion of said opening when said box is in said closed configuration; and a second pair of opposing flaps, each flap of said second pair of opposing flaps being attached to a corresponding side panel of said plurality of side panels and adapted for folding across at least a portion of said opening when said box is in said closed configuration; and a sheet having a first end affixed to said first flap and a second end affixed to said second flap, wherein when said box is in said closed configuration:

a first portion of said sheet is within said storage compartment;

a second portion of said sheet is between said first flap and at least one flap of said second pair of opposing flaps; and a third portion of said sheet is between said second flap and at least one flap of said second pair of opposing flaps; and positioning said box in said open configuration;

placing an article to be packaged on said sheet;

folding said second pair of flaps across at least a portion of said opening; and subsequently folding said first pair of opposing flaps across at least a portion of said opening and over said second pair of flaps to place said box in said closed configuration and to retain said article between said first portion of said sheet and at least one flap selected from said first and second pairs of flaps.

26. The method of claim 25, further comprising retaining said article between said first portion of said sheet and each of said first and second pairs of flaps.

27. The method of claim 25, further comprising securing said box in the closed configuration.

28. The method of claim 25, wherein said sheet has a heat shrink initiation temperature and further comprising subsequent to said folding steps heating said sheet to a temperature above said heat shrink initiation temperature of said sheet.

29. The method of claim 25, further comprising the step of placing a cushioning insert on the article on the sheet before said folding steps.

* * * * *